US005630896A

United States Patent [19]

Corbin et al.

[11] Patent Number: 5,630,896

[45] Date of Patent: May 20, 1997

[54] METHOD OF MAKING RECYCLABLE TUFTED CARPETS

[75] Inventors: James A. Corbin, Spartanburg, S.C.; Robert D. Johnson, Charlotte, N.C.; William G. Neely, Charlotte, N.C.; Ian S. Slack, Charlotte, N.C.; Barrie L. Davies, Weddington, N.C.

[73] Assignee: Hoechst Celanese Corporation, Somerville, N.J.

[21] Appl. No.: 465,804

[22] Filed: Jun. 6, 1995

Related U.S. Application Data

[62] Division of Ser. No. 203,290, Feb. 28, 1994, Pat. No. 5,532,035, which is a continuation of Ser. No. 876,617, May 1, 1992, abandoned.

[51] Int. Cl.[6] ..... B32B 3/00

[52] U.S. Cl. ..... 156/72; 156/148; 156/308.2; 428/95

[58] Field of Search ..... 156/72, 148, 308.2; 428/95, 96, 97

[56] References Cited

U.S. PATENT DOCUMENTS

| | | | |
|---|---|---|---|
| 3,019,508 | 2/1962 | Reinhardt et al. | 428/95 X |
| 3,060,072 | 10/1962 | Parlin et al. | 156/72 |
| 3,640,786 | 2/1972 | Carpenter | 156/72 X |

FOREIGN PATENT DOCUMENTS

| | | |
|---|---|---|
| 0568916 | 11/1993 | European Pat. Off. . |
| 975491 | 11/1964 | United Kingdom . |

*Primary Examiner*—Jeff H. Aftergut
*Assistant Examiner*—Sam Chuan Yao
*Attorney, Agent, or Firm*—Philip P. McCann

[57] ABSTRACT

A recyclable thermoplastic tufted fabric made of a partially meltable primary backing and tufts tufted into the primary backing. The tufts are bonded to the backing by partially melting the backing to bond the tufts and applying a secondary backing. Such a carpet can be recycled through processes known to recycle polyester.

4 Claims, 1 Drawing Sheet

METHOD OF MAKING RECYCLABLE TUFTED CARPETS

This is a division of application Ser. No. 08/203,290, now U.S. Pat. No. 5,532,035 filed Feb. 28, 1994 which is a continuation of application Ser. No. 07/876,617 filed May 1, 1992.

BACKGROUND OF THE INVENTION

This invention relates to tufted fabrics. In particular, this invention relates to a tufted fabric which may be recycled. The invention relates specifically to recyclable polyester tufted fabric but the same approach may be used with other types of polymeric based fabrics including polyamides and polypropylene.

BRIEF DESCRIPTION OF THE PRIOR ART

Tufted fabrics such as carpets and rugs are made up of various components and different types of material. Various components include a primary backing, secondary backing, latex adhesives and tuft material. It is common practice to produce fabrics such as carpets incorporating a primary backing of natural or synthetic plastic materials such as polypropylene in a woven or nonwoven fabric form. For example, broadloom carpets are normally produced by having a primary backing of woven slit film polypropylene into which there is inserted a plurality of tufts by a tufting machine. Tufts may be made from natural or synthetic fibers including wool, polyamides, polyester, polypropylene and acrylics. These tufts forming the pile of the carpet, extend through the primary backing from one face to the other in the form of loops such that long loops on one side form the pile of the carpet and the short loops being located on the opposed side of the backing. Cut pile carpet is achieved by cutting the long loops on the face of the carpet. An adhesive coating, e.g., of latex, is then applied as a primary anchor coat to the side of the primary backing opposite the pile side in order to lock the tufts in the primary backing and provide rigidity. The necessity for an anchor coat such as latex results in a relatively heavy fabric which in some cases lacks optimum flexibility.

It is well known in the industry that most carpet is disposed of in a landfill, taking up considerable space thereof. To eliminate the disposal of carpets in landfills requires the construction of carpets of recyclable materials in all parts of the carpet. One material used in carpets that is recyclable is thermoplastic polymer such as polyester. Recycling of polyester is well known and disclosed, for example, in U.S. Pat. Nos. 3,305,495; 3,907,868; and 2,465,319.

One approach to recyclable carpet would be to dissemble the carpet and recycle the individual materials. Due to the plurality of materials and the latex adhesive used in this approach to date, this is not feasible. Another approach would be to make the entire tufted fabric out of one material that is recyclable. Furthermore, the carpet would not include an adhesive coating such as latex. Such a construction would require a recyclable thermoplastic backing that could anchor the tufts. This type of construction is disclosed for example in U.S. Pat. No. 3,325,323 (Forkner) and U.S. Pat. No. 4,439,476 (Guild).

Forkner discloses a process for producing a tufted fabric by tufting fibers into a thermoplastic web and then fusing the web to bind the tufts. No reference is made to recycling the tufted fabric.

Guild discloses a process for producing a carpet having a primary backing to which is applied a meltable fibrous layer to both sides of the primary backing by needling the fibrous layer into the backing. This process is directed to improving the tuft lock. Pile tufts are inserted into the primary backing, melting the fibrous layer to secure the tufts into the primary backing. In this construction, the primary backing may be polyester and the meltable fibrous layer is disclosed to be a suitable low melt fiber. However, the disclosure does not consider the recycling of the carpet and the effects on the components thereof.

The foregoing references have disclosed various methods to attach the tufts to the backing and various uses of polyester in carpet. However, no mention is made of recycling carpets.

It would be very advantageous to develop a tufted fabric having tufts and backing made solely from one type of thermoplastic material and no foreign materials such as latex adhesives contained therein. Such a structure could be recycled with existing recycling technology particularly in the case of polyester. An object of the invention is to provide a tuft pile fabric that is completely recyclable.

SUMMARY OF THE INVENTION

The invention provides a recyclable tufted fabric made of only one type of thermoplastic material. Included in the fabric is a meltable thermoplastic primary backing in which the tufts can be inserted. Broadly, the invention provides a tufted pile fabric comprising meltable fibrous thermoplastic primary backing containing a plurality of pile tufts inserted through the primary backing, and projecting on the opposite side as insertion in order to form the pile and said primary backing being partially melted in order to secure the tufts in the backing and provide an anchor coat for the fabric. The primary backing takes the place of the standard polypropylene primary backing and the latex adhesive. This approach could be used with any thermoplastic material that is recyclable, i.e., it could be used to make a recyclable nylon or polypropylene as well as polyester as long as all the polymer in the carpet is the same type.

BRIEF DESCRIPTION OF THE DRAWING

In the drawing which forms a portion of the original disclosure of the invention.

DETAILED DESCRIPTION OF THE PREFERRED EMBODIMENT

Figure 1:
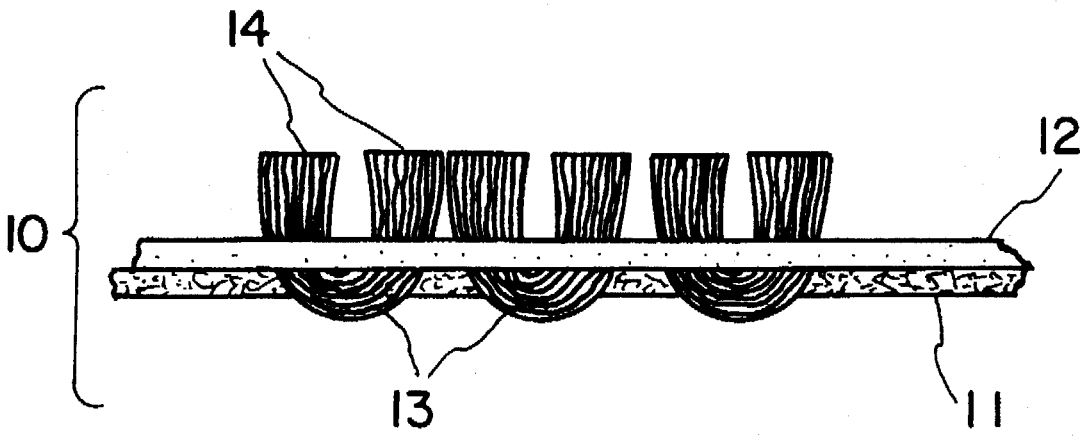
FIG. 1 is a diagramic cross-section of a fabric produced in accordance with the preferred embodiment of the present invention.

In the following detailed description, there is described a preferred embodiment of the invention for an all polyester recyclable carpet. It will be recognized that although specific terms may be used in describing the preferred embodiment, these are used in the descriptive sense and are not generic, and are used for the purposes of description and not of limitation. The invention is capable of numerous changes and variations within the spirit and scope of the teachings herein as will be apparent to one skilled in the art.

FIG. 1 illustrates a recyclable thermoplastic tufted fabric in the form of a carpet 10 of the present invention having a polyester primary backing 12 containing a percentage of low melt fiber, and tufts 14 inserted therethrough. In particular, the carpet 10 is all polyester carpet containing polyester tufts 14 and a polyester thermoplastic primary backing 12 containing low melt binder fiber. The carpet has a total weight of between about 30 and about 120 ounces per square yard preferably from 30–80 ounces per square yard. Pile weight is normally 10 to 100 ozs/yd$^2$.

The polyester primary backing 12 is a balanced use of compatible polyester fibers including binder fibers with normal polyester fiber that is capable of being bonded thereby upon activation by heat treatment of the binder fiber. In particular, the primary backing 12 is made from the blend of 5% to 95% by weight of polyester fiber having 95% to 5% by weight of crimped lower melting heterofil or homofil polyester binder fiber imparting advantageous properties to bonded batts or fabrics for the primary backing 12.

The preferred polyester for the comparable polyester fiber is poly(ethylene terephthalate), which is available commercially at relatively low cost. The denier of the polyester fiber will generally be from about 1 to about 21 dpf. In order to obtain the desired carpet properties it is preferred that the polyester fibers are crimped. Crimp levels from 3 to 18 crimps per inch (CPI) are suitable with 6 to 12 cpi being preferred. The crimped filaments can be cut to the desired length of the fibers 2.5 to 25 centimeters preferably about 7.6 centimeters. Primary backing normally of 8 to 18 ozs./yd$^2$ is needled on one or both sides with a total of typically 200–2000 penetrations per square inch (PPSI). A wide variety of needle types and stroke rates may be used to produce a fabric of proper strength and uniformity.

The primary backing may also be continuous filament of the type made by spunbond process providing it has the necessary composition of normal and low melting point binder fibers to achieve the required fabric properties.

The binder fibers are prepared from polyester polymer which has a lower melting point than the polyester polymer from which the non-binder fibers are made. A preferred binder fiber is composed of polyethylene terephthalate/isophthalate copolymer having a isophthalate/terephthalate mol ratio of about 20% to 40% which has melting temperatures of about 110° C. to 200° C.

During heat setting, the binder fiber melts and bonds the matrix polyester fiber at the cross points, so that the bonded meltable fibrous material retains the desired configuration and rigidity. When staple fibers are used the binder is in a crimped form and can be processed on conventional textile machinery to be distributed throughout the blend. It is desirable, but not essential, that the denier and cut length of the binder fiber be similar to the denier and cut length of the compatible polyester fiberfill so that the binder fiber can be distributed throughout the blend by conventional textile processing. It is generally preferred but not required, to process binder fiber of substantially the same denier as that of the compatible polyester staple fiber. Further satisfactory results can be obtained by using binder fiber of a different denier.

The amount of the binder fiber is from about 5% to about 95% of the blend, preferably from about 30% to about 70% of the blend. As the proportion of the binder fiber in the blend is increased, the resulting heat bonded backing will generally have greater rigidity. The amount of bonding will depend most importantly on whether binder is available to bond the polyester fiber at the crossover point, and the statistical probability of this increases with an increase in the amount of binder.

The denier of the binder fiber can also be less than that of the compatible polyester fiber. The denier may range from below 1 up to about 20, with deniers of 1.5 to 15 being preferred.

For example, the binder fiber may be a homofil or a bicomponent fiber, e.g., a sheath core fiber, the sheath of which comprises the lower melting binder polymer as suggested in Stanistreet, U.S. Pat. No. 4,068,036. In such circumstances, it is desirable to use sufficient bicomponent fiber so that the amount of the binder polymer is from about 20% to about 95% of the total weight of the binder fiber in the compatible polyester fiber.

Sufficient strength and dimensional stability for acceptable tufting and dyeing performance may be imparted to the primary backing 12 by proper needling during manufacture. However, if greater strength is desired, the structure may be a stitch bonded fabric.

Tufts used in the present invention may be made of any suitable recyclable polyester. The polyethylene terephthalate (PET) may include up to 50% of a comonomer such as polyethylene glycol (PEG), diethylene glycol, adipic acid, isophthalic acid and modifiers normally used to provide cationic or carrierless dyeability to the PET. The tufts can also be made from a blend of various PET or polyester fibers having different shrinkages, as disclosed in U.S. Pat. No. 5,102,713.

The bonding of the tuft into the primary backing may be enhanced by attaching a secondary backing 11 of polyester fiber after tufting but prior to dyeing of the carpet. The secondary backing applied to the back of the carpet further mechanically bonds the tufts in place but also serves as secondary backing to improve the appearance of the carpet. The secondary backing may be of sufficient weight to replace the carpet underpad. If used as an underpad, it should be applied after dyeing. The secondary backing is a non-woven fabric normally 2 to 40 ozs/yd$^2$ made from staple polyester fiber. In particular, it may be a blend of binder polyester fibers and staple polyester fibers. The secondary backing is then attached to the backside of the primary backing and may be attached by different processes. One process in particular is that which is preferred in this embodiment is the secondary backing being needled onto the backside of primary backing.

Upon-complete assemblage of the carpet, the carpet may be further processed, including dyeing, etc. The carpet is produced from the foregoing components by tufting the tufted fibers 14 into the primary backing 12 in a normal manner as completed on a tufting machine. Then the secondary web of 2 to 40 ozs/yd$^2$ non-woven fabric is needled onto the backside of the primary backing. Then the construction is dyed in the normal manner and then heat set under tension in a tenter frame in hot air of from 110° C. to 200° C.

The present embodiment may be used to make residential, contract, automotive and rug carpets of all standard constructions including cut pile, loop pile, saxony, textured, and from virtually any type of carpet fiber including BCF.

The carpet as disclosed herein may be recycled in various methods well known in the art. In particular, polyester carpet may be recycled by methods including, but not limited to 1) grinding, pelletizing, drying and extruding the pellets into polyester fiber; 2) regenerating the polyester by grinding glycolysis and batch polymerization; and 3) grinding, glycolysis and methanolysis to break the monomer down into primary DMT and glycol, the base raw materials which can then be reused to make polyester. It will be apparent to those in the art areas that this specific recycling process is determined by the type of polymer used.

The following Examples illustrate the preparation of a recyclable tufted carpet made from polyester, as well as recycling of such a carpet.

EXAMPLE 1

Two samples of the carpet were prepared, each made having a polyester primary backing, and a plurality of polyester tufts.

The primary backing was made including a blend of polyester matrix fibers and binder fibers. The polyester matrix fibers used in the two samples was T-295 polyester fibers commercially available from Hoechst Celanese Corporation and the binder fibers used in the two samples was K-54 polyester heterofil fibers commercially available from Hoechst Celanese Corporation. The fibers were blended together on standard blending equipment. Carpet Sample A included a primary backing made from a blend of 65% fiberfill and 35% binder fiber and Carpet B included a primary backing made from a 50/50 blend of fiberfill and binder fibers.

The blended fibers were carded into a web, and a batting was prepared by crosslapping the webs on standard crosslapping equipment. The batt was about 6 inches thick made up of about 10 webs. The batting was then needle punched to entangle the blended fibers and to reduce the batting to the primary backing having a thickness of about 0.10 inches. The weight of the backing and was about 14 oz./sq. yard.

The tufts were prepared from a blend of low shrinkage and high shrinkage copolyester fibers as disclosed in U.S. Pat. No. 5,102,713 which is incorporated by reference. In particular the copolyester is a copolymer of poly(ethylene terephthalate) and polyethylene glycol. The low shrinkage copolyester fiber is produced to have a shrinkage of less than 1 percent and the high shrinkage copolyester fiber has a shrinkage of about 8 percent boiling water shrinkage. The denier of the fibers is 15 dpf, the cut length 7½ inches. The crimp frequency for the low shrinkage fibers was 10½ per inch and for the high shrinkage fibers, 9½ per inch. The fibers were blended together and formed into tufts by standard equipment. The yarns/tufts were heat set in a conventional manner.

The two carpet samples were prepared by inserting the tufts into the polyester primary backing by standard tufting equipment and heating the construction to 160° C. to heat set the tufts in the primary backing. A 4 oz./yd$^2$ secondary backing consisting of 30% heterofil T-254 fiber and 70% black fiber was needed onto the primary backing to further reenforce the tufts and provide a pleasing appearance. The two carpet samples were dyed blue using conventional dyeing equipment.

EXAMPLE 2

One all-polyester carpet sample was recycled by the following steps:

1) It was cut into small pieces.
2) 100 parts of the carpet, plus 21 parts of glycolysized PET from bottle flake and 71 parts of fresh ethylene glycol were heated with stirring, to about 215° C. in a glass reactor.
3) After a suitable time the carpet had dissolved in the solution (glycolysis product was blue due to the presence of the carpet dye).
4) The glycolysis product was added slowly to a mixture of 350 parts of methanol and 0.8 parts of sodium methoxide. This mixture was at 60° C. prior to the addition of the glycolysis product.
5) Crystals of dimethyl terephthalate formed in the reactor rapidly.
6) The crystals were removed from the glass reactor and the mother liquor removed by filtration. The blue color was washed away from the DMT crystals. The foregoing indicates that the carpet can be recycled without any additional steps.

The invention has been described into considerable detail with reference to its preferred embodiments. However, variations and modifications can be made within this period and scope of this invention as described in the foregoing specification and defined in the appended claims.

What is claimed is:

1. A process for producing a tufted carpet, said process comprising providing a fibrous primary backing layer comprising thermoplastic binder fiber, inserting into said fibrous primary backing layer a plurality of fibrous tufts, said fibrous tufts extending through a face of said fibrous primary backing layer to form a plurality of anchoring loops projecting from an opposing face of said fibrous primary backing layer, thereafter, needling a nonwoven, fibrous, secondary backing layer comprising thermoplastic binder fibers to said opposing face of said fibrous primary backing layer, wherein said primary and said secondary backing layers are of the same thermoplastic material, and thereafter, heatsetting to secure said anchoring loops of said fibrous tufts.

2. The process for producing a tufted carpet of claim 1 wherein the thermoplastic material selected from the group consisting of polyester, polyamide, and polypropylene.

3. The process for producing a tufted carpet of claim 1 wherein the said binder fiber is a heterofil fiber.

4. A process for producing a tufted carpet said process comprising providing a fibrous primary backing layer comprising thermoplastic binder fibers, inserting into said fibrous primary backing layer of plurality of fibrous tufts, said fibrous tufts extending through a face of said fibrous primary backing layer to form a plurality of anchoring loops projecting from an opposing face of said fibrous primary backing layer, thereafter, needling a nonwoven, fibrous, secondary backing layer comprising thermoplastic binder fibers to said opposing face of said fibrous primary backing layer, and thereafter, heatsetting the foregoing structure to secure said anchoring loops of said fibrous tufts, wherein said primary and secondary backing layers are of the same thermoplastic material, wherein said thermoplastic material is selected from the group consisting of polyester, polyamide, polypropylene.

* * * * *